US005537369A

United States Patent [19]

Wu

[11] Patent Number: 5,537,369

[45] Date of Patent: Jul. 16, 1996

[54] DESK CALENDAR AND CLOCK COMBINATION

[76] Inventor: Lien M. C. Wu, No. 1-2, Lane 975, Chun-Jih Road,, Tao-Yuan City, Taiwan

[21] Appl. No.: 496,430

[22] Filed: Jun. 29, 1995

[51] Int. Cl.[6] ..... G04B 47/00; G04B 19/24; G09D 3/04

[52] U.S. Cl. ..... 368/10; 368/28; 368/317; 40/120; 40/358

[58] Field of Search ..... 368/10, 28, 276–278, 368/316–317; 40/335, 107, 120–122; 248/441.1, 442, 460

[56] References Cited

U.S. PATENT DOCUMENTS 2,302,410 11/1942 Bannon ..... 40/120
3,482,346 12/1969 Woofter ..... 40/120
4,740,932 4/1988 Cedhas et al. ..... 368/28
5,022,016 4/1991 Smith et al. ..... 368/223

*Primary Examiner*—Vit W. Miska
*Attorney, Agent, or Firm*—Morton J. Rosenberg; David I. Klein

[57] ABSTRACT

A desk calendar and clock combination, including: a table clock having a coupling groove at front side near the bottom; a supporting plate having a longitudinal series of through holes alinged along one side and two outward coupling flanges symmetrically disposed at two opposite ends for coupling to the coupling groove on the table clock alternatively; and a calendar consisting of a stack of loose leaves for showing the months, weeks, and days of two continuous years on two opposite pages of each loose leaf, and having a series of longitudinally spaced binding holes respectively fastened to the through holes on the supporting plate by a respective fastening element.

7 Claims, 9 Drawing Sheets

DESK CALENDAR AND CLOCK COMBINATION

BACKGROUND OF THE INVENTION

The present invention relates to a desk calendar and clock combination which includes a table clock, and a supporting plate coupled to the table clock to hold a desk calendar, wherein the supporting plate can be turned upside down so that the pages of the calendar can be turned in the reversed direction for showing the months, weeks, and days of a different year.

Various calendars are made in different forms for showing the months, weeks, and days of a particular year. FIG. 1 shows a regular vertical type monthly desk calendar (A), which consists of twelve loose leaves, each loose leaf showing the days and weeks of a particular month. FIG. 2 shows a regular horizontal type weekly desk calendar (B), which consists of a plurality of loose leaves, each loose leaf showing the days of a particular week. The horizontal type weekly desk calendar (B) can also be used as memorandums. These calendars (A) and (B) can only show the months, weeks, and days of a particular year, they cannot be used for measuring time. The horizontal type weekly desk calendar (B) is comprised of a flat supporting plate (b) and a stack of loose leaves fastened to the flat supporting plate (b) by a spring coil. When one week passed, one loose leaf a is turned to the back side of the flat supporting plate (b). When one year passed, the calendar (B) becomes useless because it cannot show the months, weeks, and days of the proceeding year. Furthermore, the design of the supporting plate (b) does not allow the horizontal type weekly desk calendar to be used in both ways for permitting the loose leaves (a) to be alternatively turned in two reversed directions to show different marks on both pages.

SUMMARY OF THE INVENTION

The present invention has been accomplished under the circumstances in view. It is one object of the present invention to provide a desk calendar and clock combination which combines a desk calendar and a table clock together for showing the months, weeks, and days of one or a plurality of particular years, and for measuring time. It is another object of the present invention to provide a desk calendar and clock combination which can be adjusted for turning the calendar in either direction. It is still another object of the present invention to provide a desk calendar and clock combination which permits the loose leaves of the calendar to be fully utilized.

According to one aspect of the present invention, the desk calendar and clock combination comprises a table clock having a coupling groove at front side near the bottom; a supporting plate having a longitudinal series of through holes alinged along one side and two outward coupling flanges symmetrically disposed at two opposite ends for coupling to the coupling groove on the table clock alternatively; and a calendar consisting of a stack of loose leaves for showing the months, weeks, and days of two continuous years on two opposite pages of each loose leaf, and having a series of longitudinally spaced binding holes respectively fastened to the through holes on the supporting plate by a respective fastening element.

According to another aspect of the present invention, the loose leaves of the calendar each has both sides printed for showing the months, weeks, and days of two continuous years.

According to still another aspect of the present invention, the calendar can be a daily desk calendar, a weekly desk calendar, or a monthly desk calendar.

DETAILED DESCRIPTION OF THE PREFERRED EMBODIMENT

Figure 1:
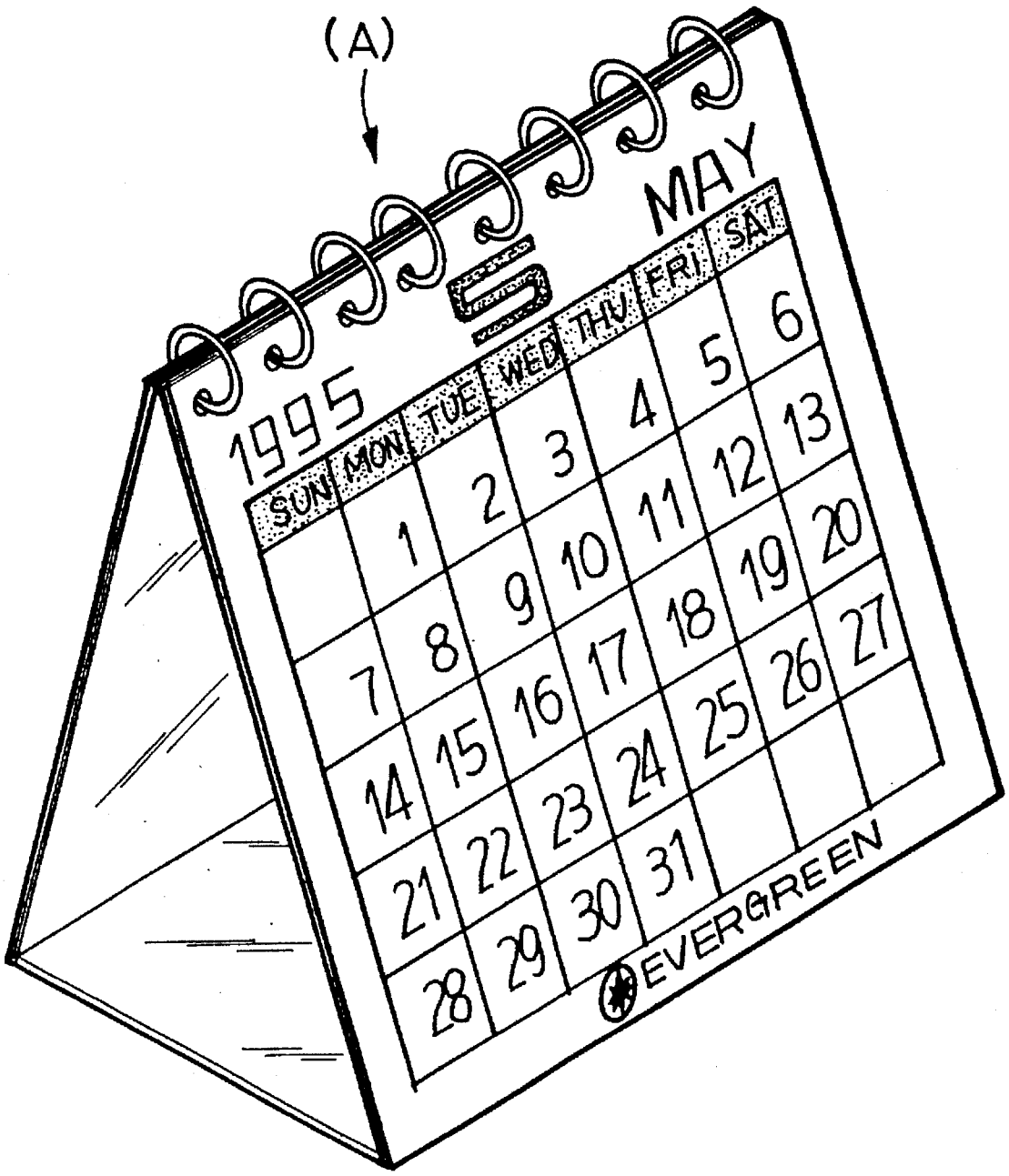
PRIOR ART FIG. 1
FIG. 1 shows a regular vertical type monthly desk calendar.
Figure 2:
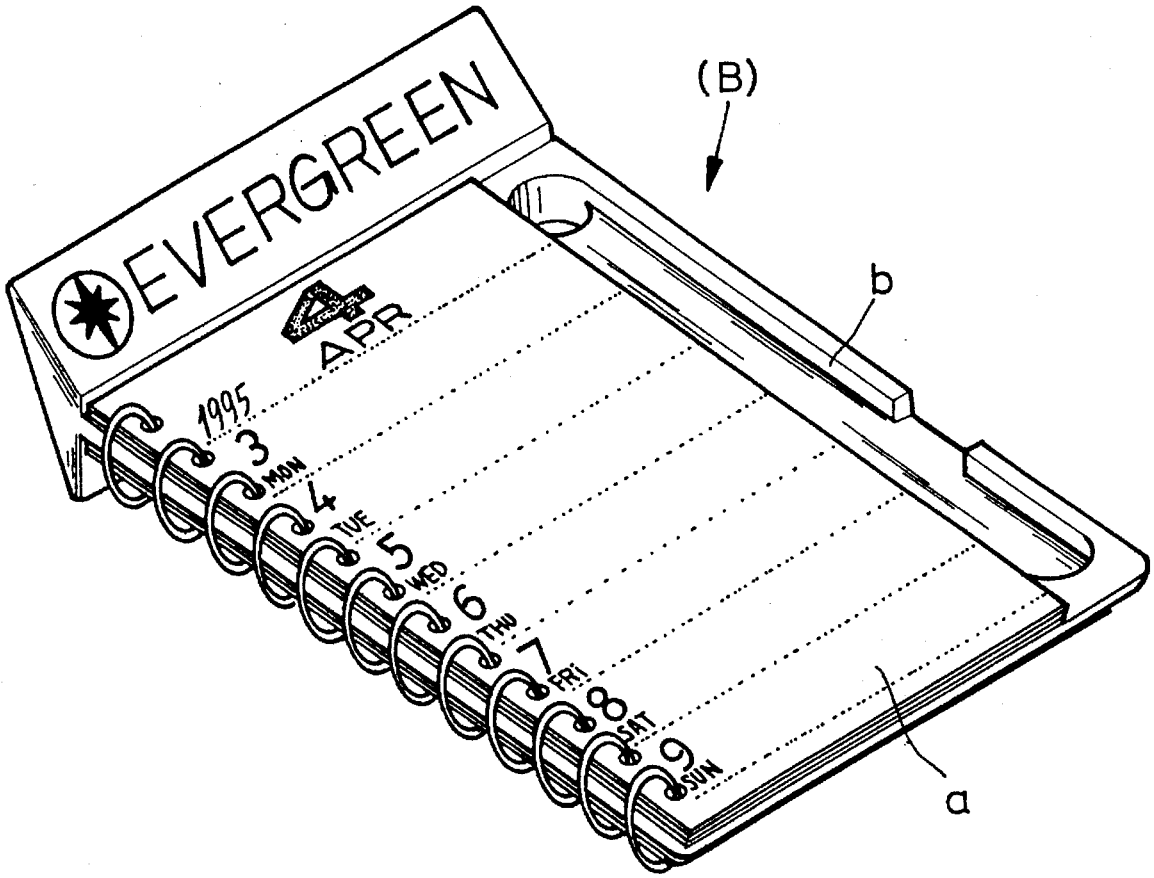
PRIOR ART FIG. 2
FIG. 2 shows a regular horizontal type weekly desk calendar.
Figure 3:
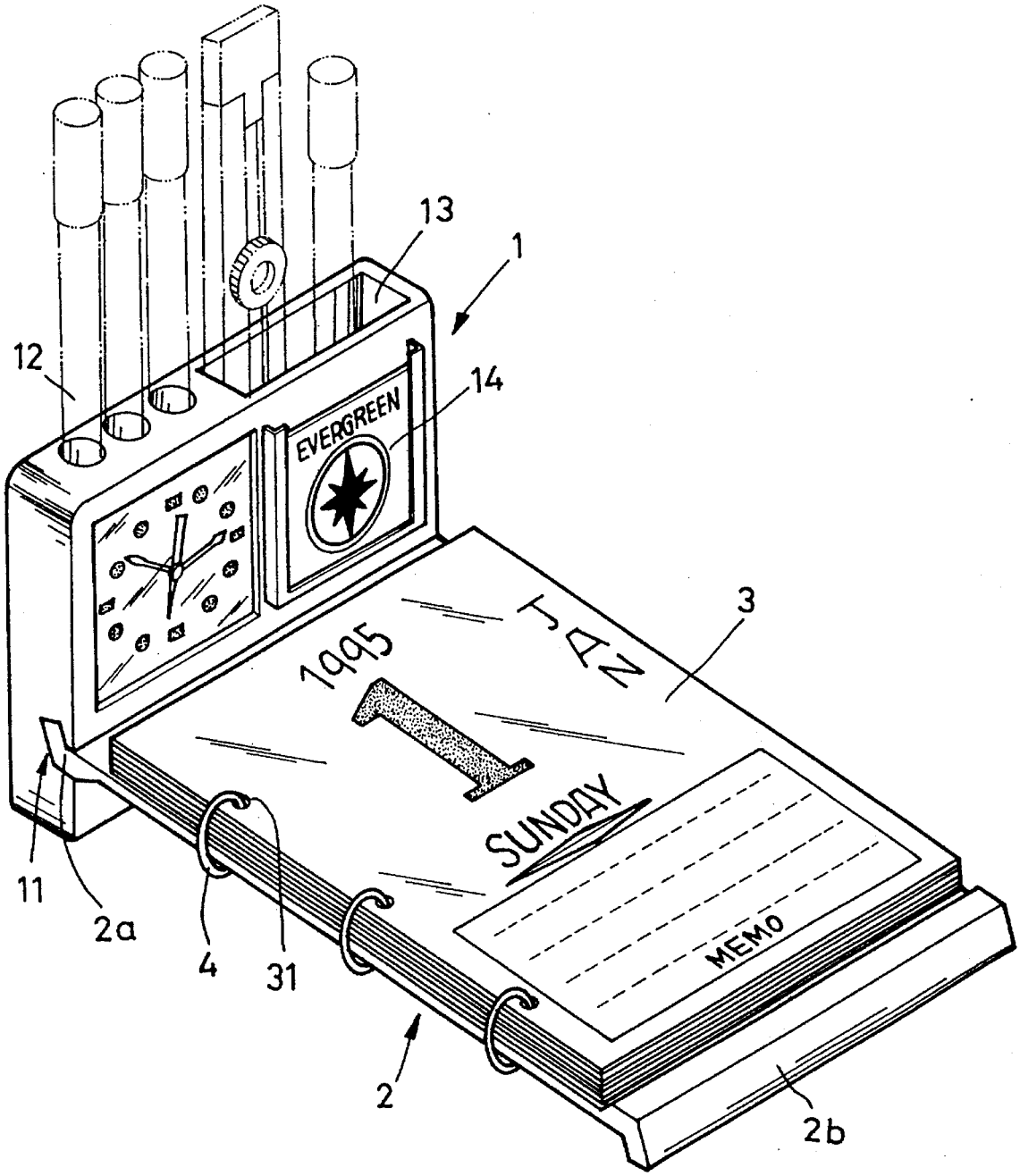
FIG. 3 is an elevational view of a desk calendar and clock combination according to the present invention.
Figure 4:
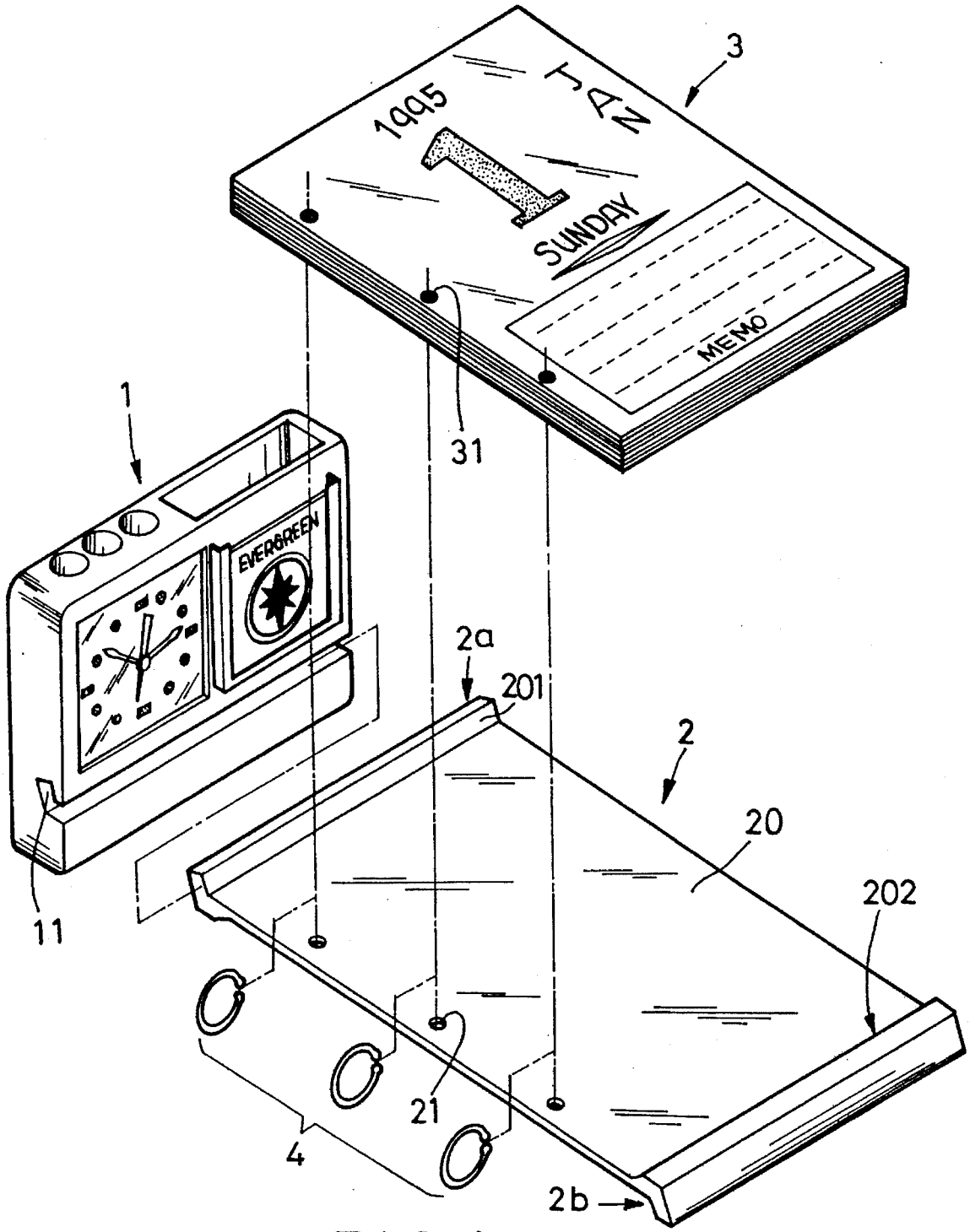
FIG. 4 is an exploded view of the desk calendar and clock combination shown in FIG. 3.
Figure 5:
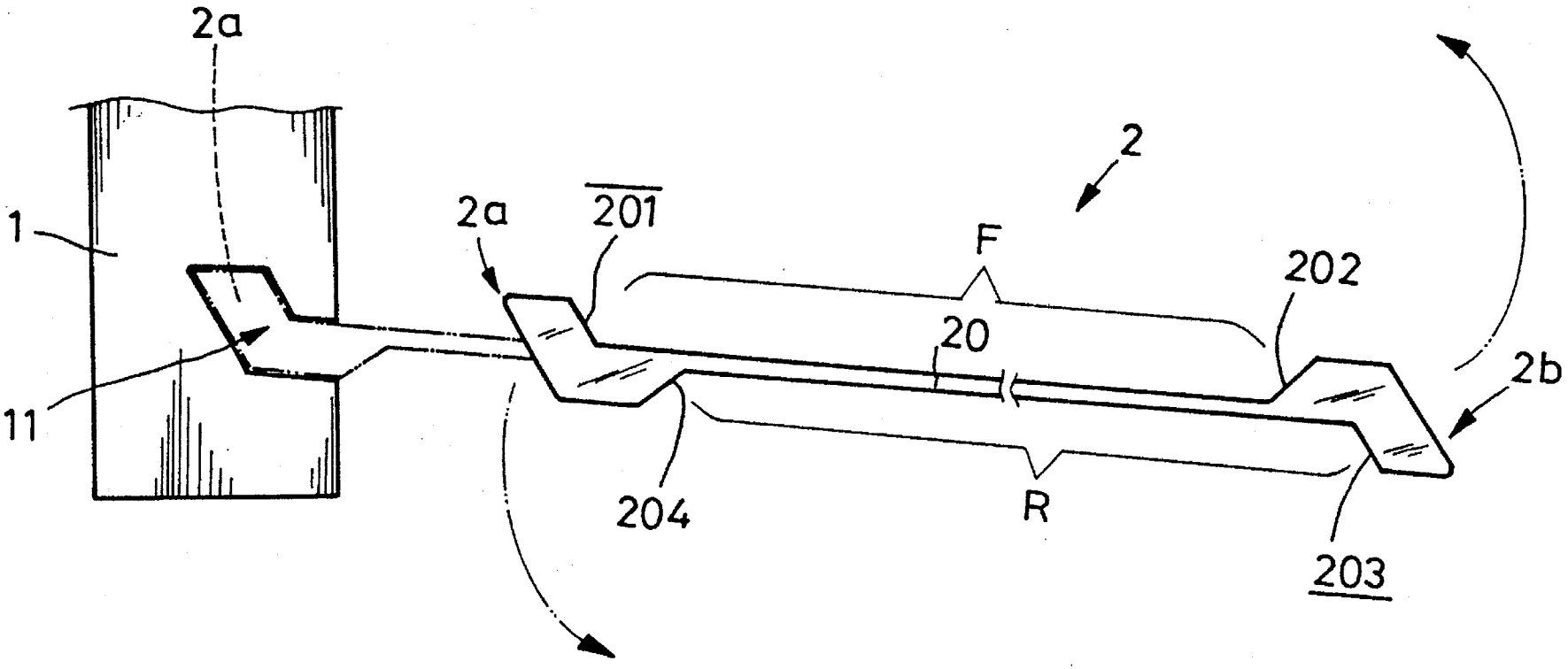
FIG. 5 is a schematic drawing showing the positioning of the supporting plate in the coupling groove on the table clock according to the present invention.

Referring to FIGS. 3, 4, and 5, a desk calendar and clock combination in accordance with the present invention is generally comprised of a table clock 1, a supporting plate 2, and a calendar 3. The supporting plate 2 comprises a flat body 20 having a longitudinal series of through holes 21 longitudinally aligned along the border, two opposite outward coupling flanges **2*a* and 2*b* symmetrically disposed at two opposite ends, two first transverse slopes 201 and 202 respectively raised from the flat body 20 at one side and defining with the flat body 20 a first holding space F, and two second transverse slopes 203 and 204 respectively raised from the flat body 20 at an opposite side and defining with the flat body 20 a second holding space R. The calendar 3 has a longitudinal series of binding holes 31 longitudinally aligned along one side and respectively fastened to the through holes 21 on the supporting plate 2 by coiled spring elements 4. The table clock 1 has a coupling groove 11 transversely disposed at the front side neat the bottom for coupling the supporting plate 2. The cross section of the coupling groove 11 curves upwards. The cross section of the outward flange 2*a* or 2*b* fits that of the coupling groove 11. By fastening the outward coupling flange 2*a* or 2*b* to the horizontal coupling hole 11, the supporting plate 2 is fastened to the table clock 1** in a sloping position. Therefore, the desk calendar and clock combination can be conveniently assembled by hand without the use of any tools.

Referring to FIG. 3 again, the table clock 1 further comprises a plurality of pen holders 12 and a storage chamber 13 at the top side for holding pens and keeping accessories respectively, and a card holder 14 at the front side for keeping business cards, telephone cards, pictures, etc.

Referring to FIG. 5 again, because the outward coupling flanges 2*a* and 2*b* are symmetrical, they can be alternatively coupled to the coupling groove 11 on the table clock 1.

Figure 6:
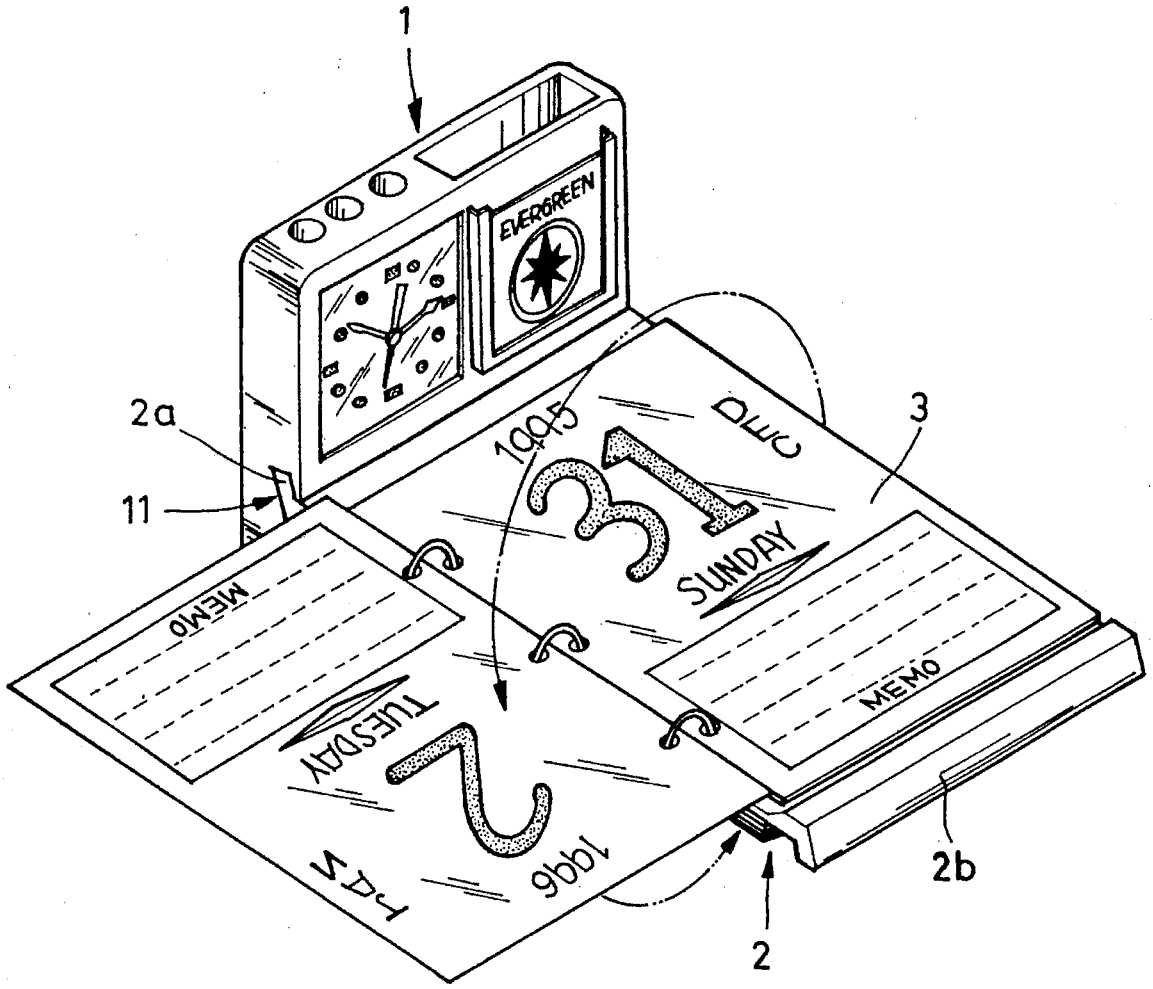
FIG. 6 shows an application example according to the present invention.
Figure 7:
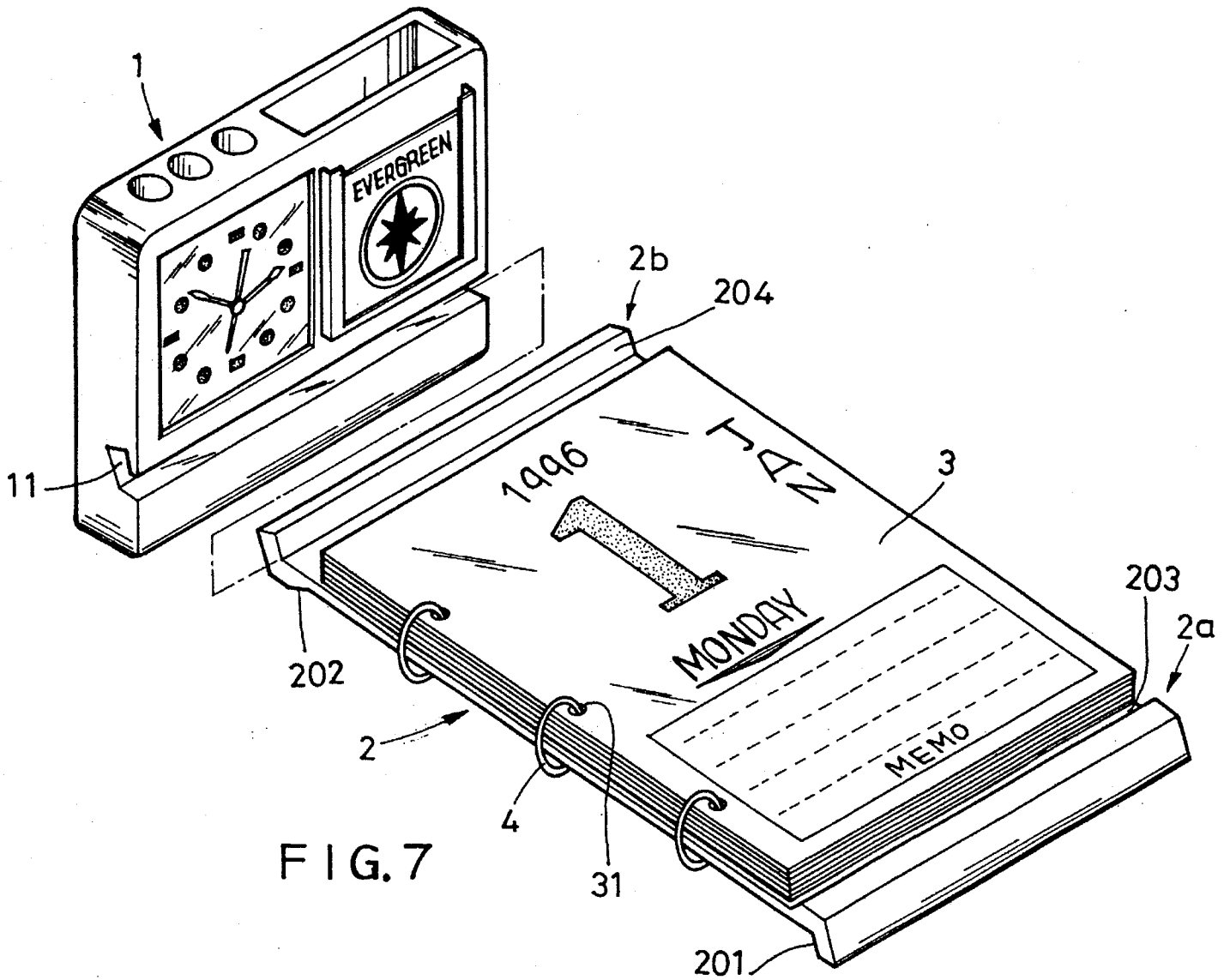
FIG. 7 shows the supporting plate disconnected from the table clock and turned upside down according to the present invention.

Referring to FIGS. 6 and 7, the calendar 3 can be a daily desk calendar for showing the months, weeks, and days of two continuous years respectively on both sides of each loose leaf, for example, the front page of one loose leaf shows the date of Dec. 30, 1995, and its back page shows the date of Jan. 2, 1996; the front page of one loose leaf shows the date of Dec. 31, 1995, and its back page shows the date of Jan. 1, 1996. When 1995 is ended, the supporting plate 2 is turned upside down, permitting the page which shows the date of Jan. 1, 1996 to be disposed at the top side. Therefore, the daily desk calendar 3 can be used for two years.

Figure 8:
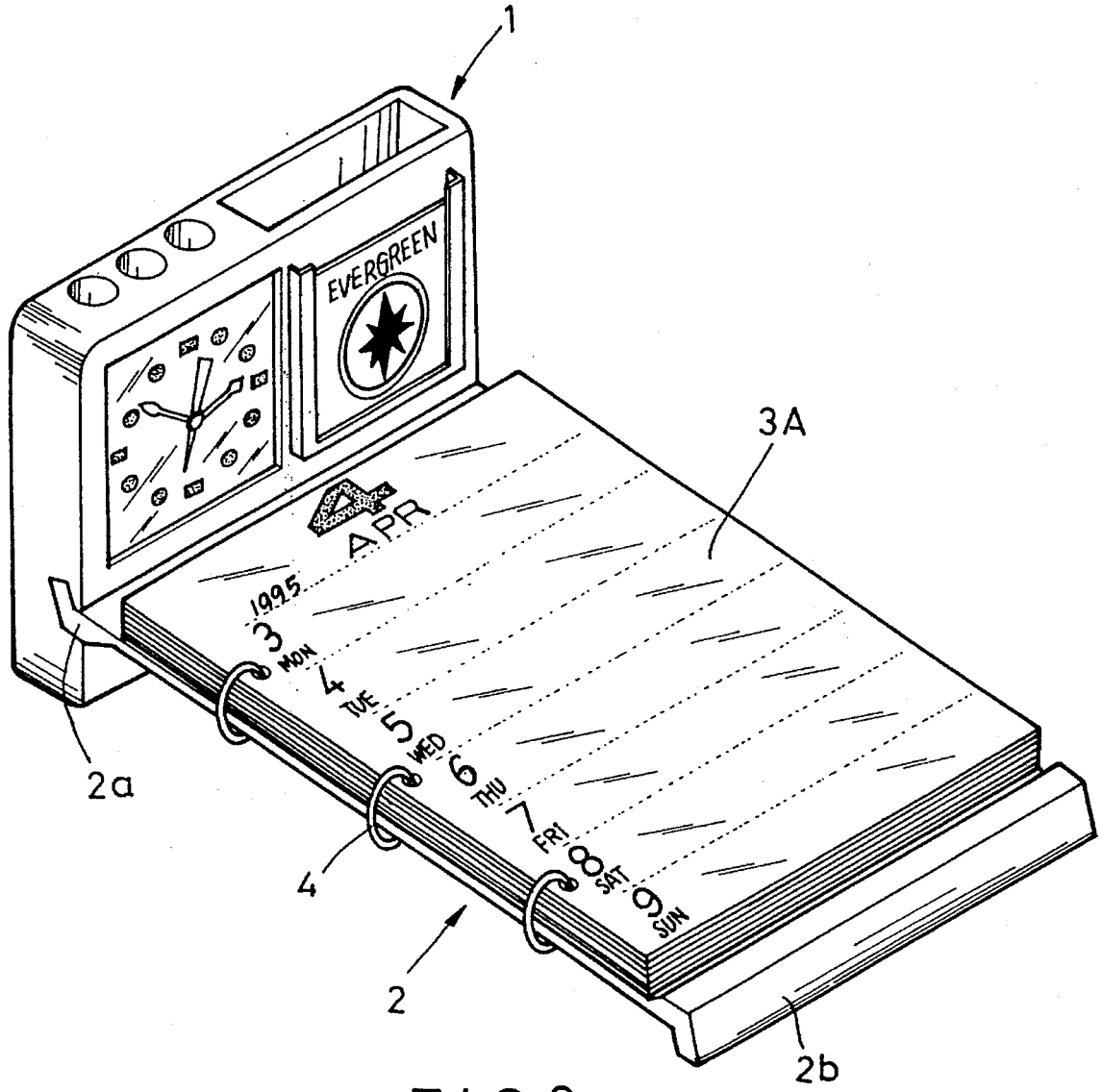
FIG. 8 shows an alternate form of the calendar mounted on the supporting plate according to the present invention.

Referring to FIG. 8, a weekly desk calendar 3A can be used and fastened to the supporting plate 2 to replace the aforesaid daily desk calendar 3, each loose leaf of the weekly desk calendar 3A shows the seven days of a particular week.

Figure 9:
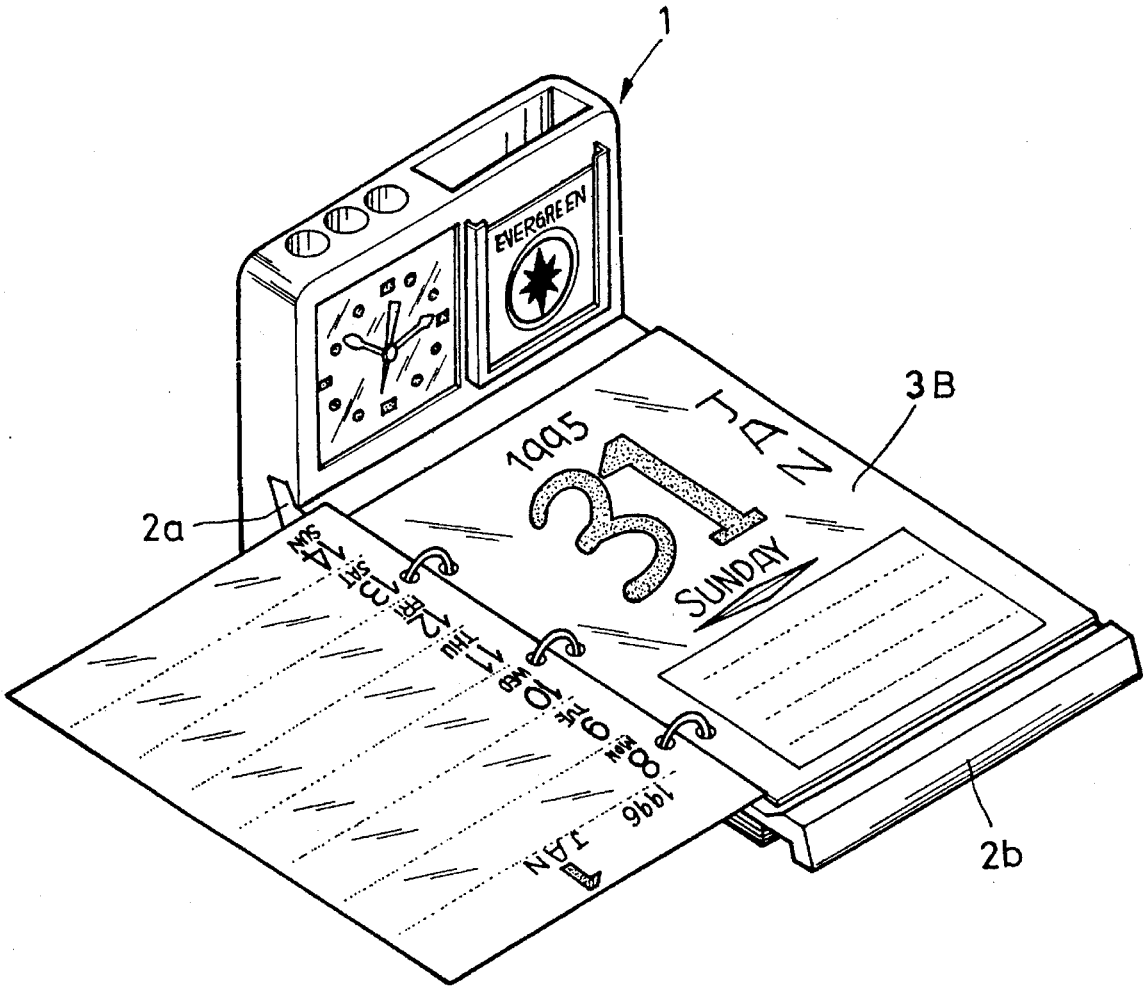
FIG. 9 shows another alternate form of the calendar mounted on the supporting plate according to the present invention.

FIG. 9 shows an alternate form of the desk calendar according to the present invention. This alternate form of desk calendar, referenced by 3B, shows the months, weeks, and days of a particular year on the front pages of the loose leaves, and the months, weeks, and days of seven continuous years on the back pages of the loose leaves. Therefore, the desk calendar 3B is applicable for showing the months, weeks, and days of as much as eight years.

It is to be understood that the drawings are designed for purposes of illustration only, and are not intended as a definition of the limits and scope of the invention disclosed.

What is claimed is:

1. A desk calendar and clock combination, comprising:

a table clock having a bottom and coupling groove near the bottom;

a supporting plate having a longitudinal series of through holes alinged along one side and two outward coupling flanges symmetrically disposed at two opposite ends for coupling to the coupling groove on said table clock alternatively; and a calendar consisting of a stack of loose leaves for showing the months, weeks, and days of at least one particular year, and having a series of longitudinally spaced binding holes respectively fastened to the through holes on said supporting plate by a respective fastening element.

2. The desk calendar and clock combination of claim 1 wherein the coupling groove of said table clock curves upwardly backwards from one side of said clock toward an opposite side; said supporting plate comprises two coupling flanges symmetrically disposed at two opposite ends for coupling to the coupling groove on said table clock alternatively, two first transverse slopes respectively raised from said flat body at one side and defining with said flat body a first holding space for holding a calendar on said supporting plate, and two second transverse slopes respectively raised from said flat body at an opposite side and defining with said flat body a second holding space for holding a calendar on said supporting plate.

3. The desk calendar and clock combination of claim 1 wherein the loose leaves of said calendar each has both sides printed for showing the months, weeks, and days of two continuous years.

4. The desk calendar and clock combination of claim 1 wherein said calendar is a daily desk calendar.

5. The desk calendar and clock combination of claim 1 wherein said calendar is a weekly desk calendar.

6. The desk calendar and clock combination of claim 1 wherein said calendar is a monthly desk calendar.

7. The desk calendar and clock combination of claim 1 wherein said table clock comprises a plurality of pen holders and a storage chamber at a top side for holding pens and keeping accessories respectively, and a card holder at a front side for keeping cards.

* * * * *